United States Patent [19]

Turley et al.

[11] Patent Number: 4,551,878

[45] Date of Patent: Nov. 12, 1985

[54] STRIP WIPING SYSTEM

[76] Inventors: John W. Turley, 14 Pine St., Oxford, Conn. 06483; Michael G. Sendzimir, E. Hill Rd., Woodbury, Conn. 06798

[21] Appl. No.: 677,491

[22] Filed: Dec. 3, 1984

[51] Int. Cl.[4] ..... B21B 45/02

[52] U.S. Cl. ..... 15/102; 15/3; 29/81 A; 72/163; 100/153; 100/171

[58] Field of Search ..... 15/4, 102, 3; 100/176, 100/171, 153; 29/81 A; 226/52; 72/163, 40, 72/242, 243

[56] References Cited

U.S. PATENT DOCUMENTS

| | | | |
|---|---|---|---|
| 2,824,321 | 2/1958 | Bandy | 29/81 A |
| 3,020,624 | 2/1962 | Menster | 29/81 A |
| 3,289,448 | 12/1966 | Wiig | 72/162 |
| 4,074,555 | 2/1978 | Noé | 72/163 X |
| 4,127,066 | 11/1978 | Sharkey | 100/176 |

*Primary Examiner*—Edward L. Roberts

[57] ABSTRACT

An improved device for wiping liquids from the surface by moving metal strip under tension, such as strip produced by cold rolling mills, is disclosed. The device consists of three rollers, between which the strip passes, where each roller is supported by a plurality of pairs of casters, the caster pairs being spring mounted in a pair of frames, the frames being urged together by fluid powered cylinders, so that the rollers are held against the strip surfaces under pressure, thus wiping the strip surface by preventing passage of liquid on the strip surface past the rollers.

3 Claims, 5 Drawing Figures

STRIP WIPING SYSTEM

BACKGROUND OF THE INVENTION

In the cold rolling of metals it is normally necessary to supply copious quantities of a liquid to provide lubrication and cooling of rolls and the rolled strip. The energy of deformation of the rolled product appears as heat, which must be removed by the coolant in order to avoid excessive temperature of the strip and of the rolls. When rates of deformation are high, the rate of heat generation is high, and high coolant flow rates are necessary. For example, a Sendzimir mill rolling 50 inch wide stainless steel typically uses a coolant flow rate of around 1000 gallons per minute.

In general, the coolant medium is oil based, and typical types used are straight mineral oil, water/oil emulsions, (usually containing about 5 to 12% oil) either based upon mineral oils, or upon vegetable oils such as palm oil. It is usual to incorporate chemical additives in the oil, such as extreme pressure (E.P.) additives to increase film strength, anti-oxidants, anti-rust compounds (in case of water/oil emulsions), anti-foam compounds and so on.

Subsequent to the rolling process the strip is frequently transferred to a process for which it is necessary to have little or no coolant (or additives) remaining on its surface. For example, when coils are batch annealed, surface oil can cause "stickers" (where adjacent laps of the coil stick together) and "staining" (discoloration of strip surface due to impurities or additives in the coolant). In some cases the strip can be cleaned before being transferred to the next process, but even then, cleaning is an additional cost to the strip processing operation, and elimination or reduction of the requirement for cleaning is a very worthwhile objective. Furthermore, even coiling of strip with an oily surface is hazardous, particularly at light gauges, because "telescoping" of the coil can readily occur ("telescoping" is when adjacent laps of the coil slide over one another in an axial direction, causing the strip emerging from the rolling mill to be forced to the side, thus producing a mill wreck). Surface oil can also adversely affect the measurement accuracy of strip thickness measuring equipment.

For this reason, it is usual to provide cold rolling mills with strip wipers, which have the function of wiping the oil from the surface of the strip as it emerges from the mill, usually before the strip reaches the strip thickness gauges.

There are three basic types of strip wipers:

(1) Bar wipers

These consist of two strips or bars of a suitable wiping material, one above and one below the strip. These bars are mounted transverse to the strip, and extend beyond the strip edges. They are provided with rigid support frames and are squeezed together against the strip under pressure. Thus they provide a "squeegee" like action. Typical materials for the bars are rubber hose (commonly used for mineral oils) and felt (commonly used for soluble oils).

Bar wipers have three major defects. Firstly, the bars are damaged very quickly by the strip edges, so have to be changed frequently (delays production). Secondly, any metal chips produced by the rolling process tend to become embedded in the material of the bars, and will then scratch the strip surface. Thirdly, they provide a high friction drag on the strip, which can result in strip breakage, particularly at light gauges, and if the strip edges are not smooth.

(2) Air flow type wipers

These wipers required a continuous flow of air generated either by a compressor or fan (air jet type) or by a vacuum ejector or fan (vacuum type).

The action of these wipers is that of sweeping the coolant off the surface of the strip by high velocity air flow. This is the same principle as that of the vacuum cleaner.

Air jet type wipers are inexpensive to install, but expensive to run due to the cost of supplying compressed air. They are not very effective, and are usually noisy.

Vacuum type wipers, usually operating in combination with bar wipers are quite effective, especially when rolling very light gauge materials at high speed. However, they are expensive to buy, and expensive to run due to the cost of running vacuum ejectors or fans.

(3) Roller wipers

There are two types of roller wipers - two roll wipers and three roll wipers.

Two roll wipers are similar to bar wipers except that the wiper bars and support frames are replaced with two rollers, usually made of steel or bronze, one mounted above the strip, vertically above a second one mounted below the strip. These rollers are mounted in chocks at their ends, and the force which squeezes them together against the strip is applied to the chocks. Thus the rollers tend to bend under load, and must usually be provided with a crown, in order to apply uniform pressure and thus uniform wiping action at all points across the strip. Two roll wipers have the advantage that damage due to strip edges is minimal, and they will usually not scratch the strip, but have the disadvantage firstly that their wiping, at its best, is inferior to that of bar wipers (probably because the oil film can penetrate the nip area due to hydrodynamic lift effects) and also that, if the strip profile is irregular, or if the roll crowns are not exactly suitable for the applied wiping pressure, then wiping will be non-uniform, and bands of oil will be visible on the strip as it emerges from the wipers.

Three roll wipers utilize two rollers, side by side (i.e. with axes parallel) above the strip, and a single roller below the strip, with its axis vertically below a line mid-way between the axes of the upper rollers. Note that it is possible to have two rollers below, and one above the strip, but it is better practice to use two rollers above the strip and one below, since more coolant has to be removed from the upper side of the strip. For three roll wipers to be effective the strip must be under tension (which is the usual condition when cold rolling) since although the upper and lower rolls are urged towards each other by hydraulic cylinders (or other means) in order to press them against upper and lower strip surfaces, the pressure with which they are urged must not be strong enough to cause the rollers to "pinch" the strip, but must be strong enough to give good wiping action. Correct operation of 3-roll wipers is illustrated in FIG. 3 where it can be seen that between each roll/strip contact zone and the next there is a free length of strip 110 (under tension). This free length of strip is very important, since it is able to flex, so that, even if the crowns in upper and lower wiper rolls do not exactly match their deflections, substantially uniform wiping pressure will be obtained in each roll/strip contact zone, across the full width of the strip. Since it is only the strip tension, acting via the wrap angle of the strip around each roll which balances the pressure applied by the hydraulic cylinders, it follows that the strip tension must be sufficiently high to balance the applied pressure.

Prior art three roll wipers wipe more uniformly than two roll wipers and offer all the other advantages of two roll wipers. However, they do not wipe as effectively as bar wipers so cannot be used in critical applications.

Typical construction of prior art 3-roll wipers is shown in FIGS. 1 and 2. Wiper rollers 11 are hollow, and are rotatably mounted upon "dead" or stationary shafts 13 by means of ball bearings 12. Shafts 13 are mounted in chocks 14 (upper roller) and 15 (lower roller), spaced from roller ends by spacers 26. Lower chocks 15, are slideably mounted in frames 16, which are attached to mill housings 20 and 21 by means of screws 24'. Hydraulic cylinders 18 mounted to mill housings 20 and 21 by means of brackets 19 and screws 22 are used to set the upper rollers in a fixed horizontal position so that their lower generators lie on the pass line, by preloading upper chocks 14 against frames 16 via spacers 17. Hydraulic cylinders 23, mounted upon frames 16, are supplied with hydraulic oil at an adjustable constant pressure, and are used to urge the lower wiper roller upwards against the lower surface of strip 25.

Our experience with prior art three roll wipers on a number of installations has taught us that smaller wiper rollers and harder roller materials remove oil from the strip more effectively. This can be explained by the fact that with harder materials and smaller roller diameters, the contact area between wiper roller and strip (for a given applied force) is smaller, and hence the average pressure between roller and strip is higher, enabling each roller to "bite" through the oil film more effectively. However, using the prior art method of mounting wiper rollers in chocks, it is not practical to reduce the roller diameter to less than about 1/12 of the strip width. Furthermore, at diameters of this size, the space taken up by the three roll wipers in the direction of strip travel, which usually has to be about 2½ roller diameters as can be seen from FIG. 2, is relatively large, and it is thus frequently impossible to retrofit such wipers on to existing rolling mill installations, because there is insufficient space. It is also found that, at least on the larger (50 or 60 inch wide) installations, the wiper rollers are heavy, and changing of rollers can be very time consuming.

DESCRIPTION OF THE INVENTION

To overcome the deficiences of prior art three roll wipers our invention incorporates much smaller diameter wiper rollers than those of the prior art and means for mounting and supporting these wiper rollers.

Figure 2:
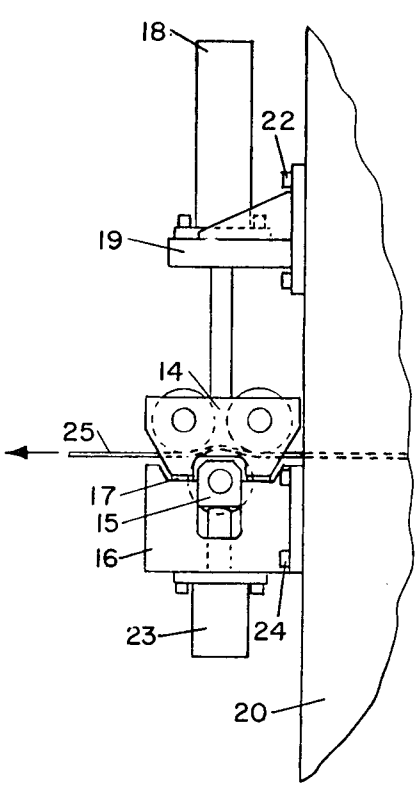
FIG. 2 (PRIOR ART)
FIG. 2 is a end view of the device of FIG. 1.
Figure 1:
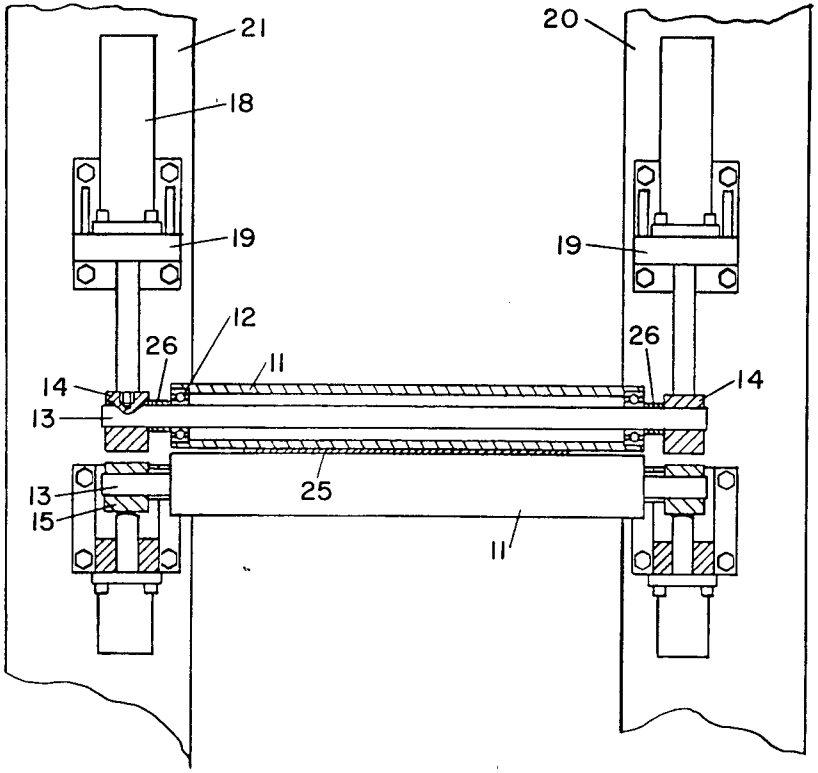
FIG. 1 (PRIOR ART)
FIG. 1 is a partly sectional view of prior art three-roll wipers.
Figure 3:
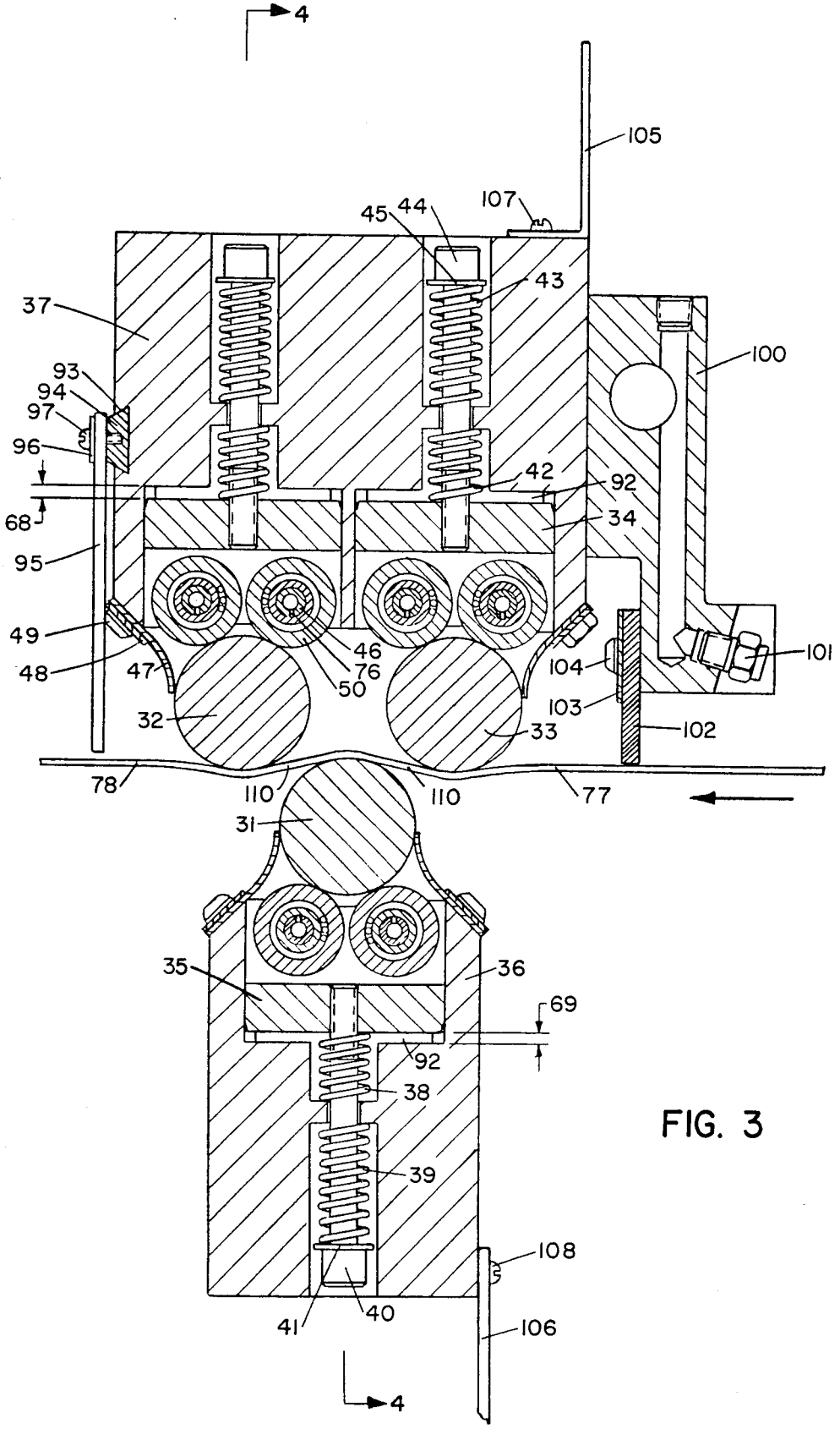
FIG. 3 is a sectional view of the three-roller wiper device of the present invention.
Figure 4:
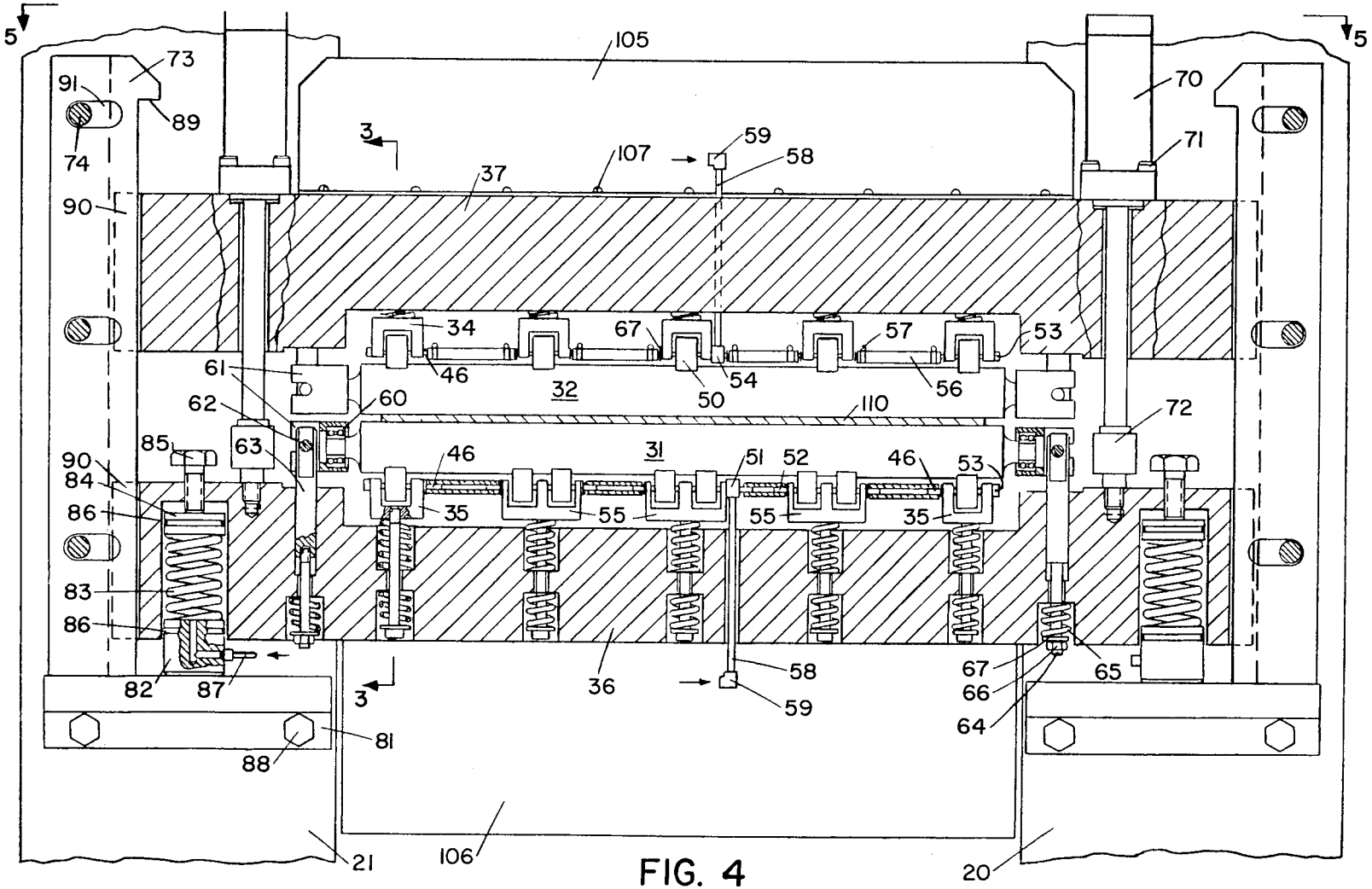
FIG. 4 is a sectional view taken along line 4—4 of FIG. 3.
Figure 5:
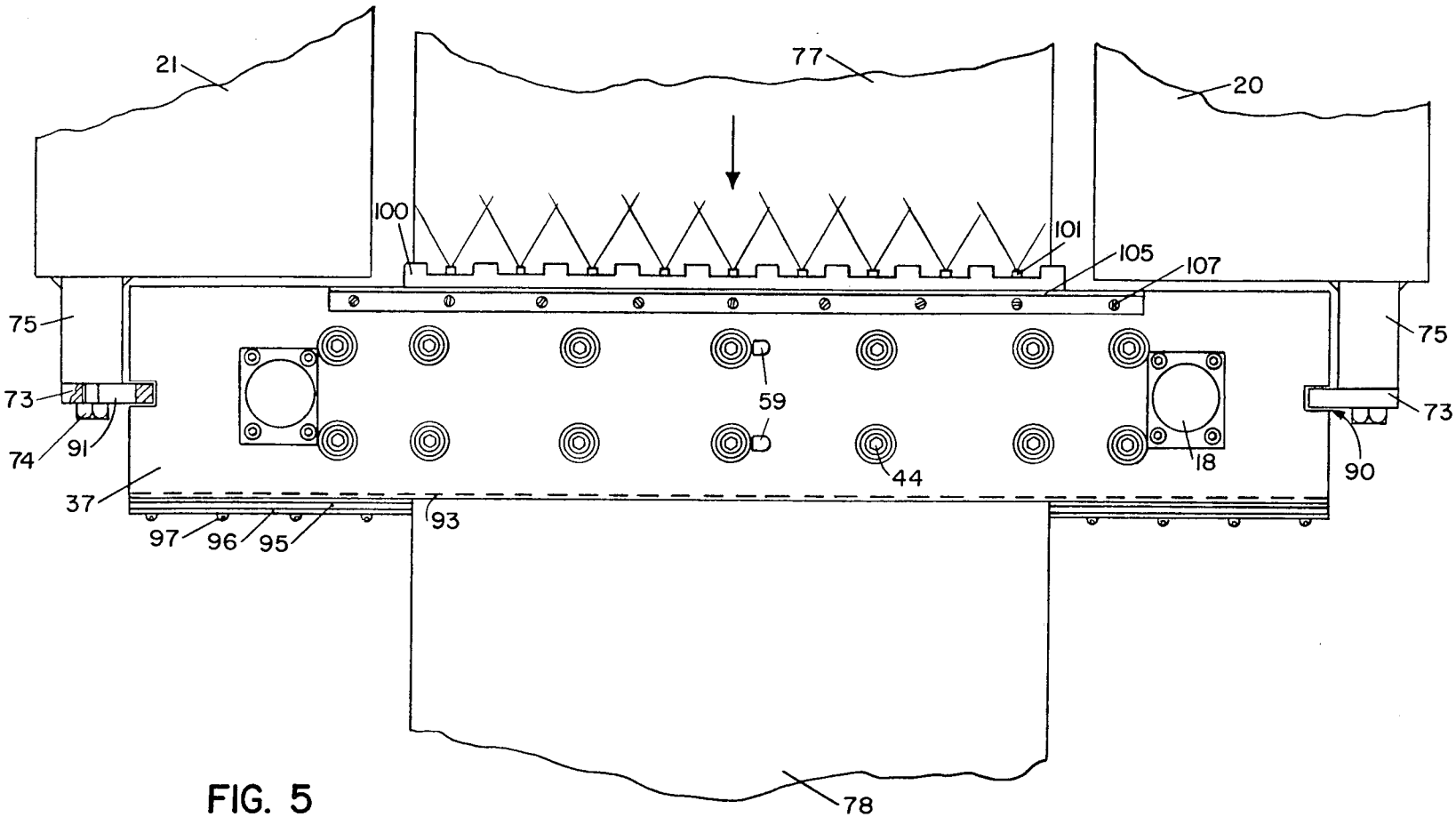
FIG. 5 is a view taken along line 5—5 of FIG. 4.

The invention will now be described with reference to the embodiment of FIGS. 3, 4 and 5.

The strip 77,78,110 passes between, and is wiped by two upper wiper rollers 32 and 33 and a lower wiper roller 31. The upper wiper rollers are each supported by several pairs of caster bearings 50 equally spaced along the length of the wiper rollers, these caster bearings being mounted upon hollow shafts 46 or 54 and forming two separate coaxial rows. Each coaxial row of caster bearings is lubricated by oil mist supplied via pipe elbow 59, nipple 58 and shaft 54, said shaft being provided with a tee connection to accept, said nipple, and differing from shafts 46 only in this respect. Elastomeric hoses 56, secured by hose clamps 57 are used to connect each shaft to its neighbor in each coaxial set, and caps 53 are used to plug the two end shafts 46 to prevent escape of oil mist. Thus the oil mist, used to lubricate the bearings, is delivered to shafts 46 via shaft 54 and hoses 56. From the central hole in each hollow shaft 46 (and in shaft 54) the oil mist flows radially through, and is reclassified by radial orifice 76 in the shaft, and hence to caster bearings 50. It should be understood that the caster bearings are commercial roller bearings which incorporate lubrication holes through which the lubricant can flow to the rollers and raceway surfaces.

Each pair of caster bearings 50 is mounted upon a pair of shafts 46 (or 54) and said shafts are mounted in a carrier 34, and retained axially in said carrier by snap rings 67. Each carrier is spring mounted in upper frame 37 by means of springs 42 and 43, screw 44 and washer 45. Screws 44 are tightened until clearance 68 between carrier and frame is the same for all carriers. Recesses 92 in the upper frame are used for guiding carrier 34 so they can only move in a vertical direction.

Lower wiper roller 31 is supported by a system of caster bearings and carriers, spring mounted in lower frame 36, in a similar manner to the support system described above for the upper rollers 32 and 33. However, because the vertical force supported by the lower roller is double that of each of the upper rollers (said force being shared equally between the two upper rollers) lower support springs 38 and 39 are stiffer than the corresponding upper support springs 42 and 43, and the central carriers 55 each support two pairs of caster bearings 50. The end carriers 35 each support one pair of caster bearings, and are identical to upper carriers 34. Lower shafts 51 and 52 are similar to the respective upper shafts 54 and 46, except for the increased length corresponding to carriers 55, and lubrication holes to suit location of the two bearings mounted on each shaft. Lower support spring adjusting screws 40 are each adjusted to set the clearance 69 between carrier 35 (or 55) and lower frame 36, this clearance being the same for all carriers.

To maintain each wiper roller nested between the two coaxial rows of caster bearings, a pull-back system is used. Each wiper roller is provided with a roller neck bearing 60 at each end, each bearing being mounted within a housing 61. A ball detent pin 62 (of the type known as "ball-lock pins" and marketed by the Carr-Lane Corp.) is used to attach this housing to a guide rod 63. The rod is urged away from the strip by means of spring 65, acting via stud 64, nut 66 and washer 67. In order to remove a wiper roller from the assembly, stud 64 is urged towards the strip (by external means such as a pry-bar) and this relieves the spring load from ball detent pin 62, which can then be manually removed. This procedure is repeated at the other end of the wiper roller which can then be removed. Note that, in the case of the upper wiper rollers only, the wiper roller must be supported against gravity by hand while ball detent pins are removed, and then it can be carried away. The lower wiper roller can simply be lifted out after ball detent pins are removed.

The lower frame 36 is supported at each end on the mill housing 20 (or 21) by means of shelf 81, (which is attached to the mill housing by screws 88) spring 83, plunger 82, spacer 84 and adjusting screw 85. The upper frame 37 is connected to the lower frame by two hydraulic cylinders 70, one located at each end of the upper frame. Each hydraulic cylinder 70, is flange mounted to the upper frame by screws 71, and its piston rod is connected to the lower frame by universal joint 72. The cylinders are used to open and close the wipers, the wipers being opened to provide a gap between upper and lower wiper rollers when threading the strip through the mill, and closed together in order to wipe the strip.

Upper and lower frames are each provided with a slot 90 at each end. Each slot engages with guide key 73, which is attached to stand-off 75 by means of screws 74, said stand-off being to assist the operation of springs 83. In such cases plungers 82 and spacers 84 can be provided with seals 86, and compressed fluid can be supplied through pipe 87. In such cases the level of the assembly can be adjusted either by adjusting screws 85 or by adjusting the pressure of the compressed fluid using a pressure regulator. It is also possible to use compressed fluid only, and eliminate springs 83.

In general, it is more difficult to wipe the upper surface of strip than the lower surface, since gravity causes oil to remain on the upper surface, but to fall away from the lower surface. For this reason, not only are there two wiper rollers 32 and 33 wiping the upper surface of the strip, and only one wiper roller 31 wiping the lower surface of the strip, but also two additional devices are used to help the upper wipers. Firstly a plurality of spray nozzles 101, mounted in spray header 100, and spaced across the width of the strip, are used to spray the upper surface of strip 77 emerging from the rolling mill, in a direction opposite to the direction of strip travel. These nozzles are supplied with the same coolant used for lubricating the rolls of the rolling mill, and the effect of said spray is to dam the coolant being carried away from the mill rolls on the upper strip surface so that a large percentage of said coolant spills over the strip edges before the strip reaches the wiper rollers. Secondly, dam 102, mounted to spray header 100 by means of screws 104 and back-up plate 103, and covering the whole width of the strip, and located so that its lower edge just clears the upper surface of the strip, is used to minimize the amount of coolant on the upper surface of the strip reaching the wiper roller. Said dam is made of an elastomeric material such as neoprene which is stiff enough to provide the necessary damming force, but flexible enough to bend elastically and not break in the event that the strip breaks and a broken strip end impacts the dam.

Baffles 47, attached to upper frame 37 and lower frame 36, by means of screws 49 and back-up plate 48, bear against each wiper roll, and are used to prevent coolant from being carried or splashed from the entry side to exit side through the welded, as shown, or screw mounted to housing 20 or 21. Guide keys 73 are themselves provided with slots 91. In order to remove the wiper assembly from the mill, screws 74 are loosened and keys 73 slid back out of engagement with slots 90 in upper and lower frames and the assemblies lifted out.

Guide keys 73 are provided with tabs 89 at their top end. In operation, the weight of the whole assembly, including upper and lower frames, rests upon springs 83, and screws 85 are adjusted to set the level of the top of lower wiper roller 31 at the pass line (with wiper rollers closed). When cylinders 70 are extended to open the wipers in order to provide space for threading the strip through the wipers at the start of operations, initially the upper frame lifts and the lower frame remains at the same level (top of lower wiper roller at the pass line). When the top of the upper frame reaches the tabs at the top of the guide keys, further upward movement of the upper frame is prevented by said tabs, and the lower frame starts to move downwards, compressing springs 83 until the cylinders reach the end of their stroke. In this way opening of both upper and lower frames is achieved with a single hydraulic circuit.

When cylinders 70 are retracted in order to close the wipers and commence wiping, initially the lower frame lifts until the top of the lower roll reaches the pass line, then the upper frame starts to move down. From this point onwards, springs 83 are supporting the full weight of upper and lower assemblies as the upper frame moves down, so their deflection, and hence the level of the top of the lower roll, remains constant. The final position of the upper frame is determined by the strip thickness and tension, and by the pressure of oil in cylinders 70. Because strip thickness and tension vary, the hydraulic circuit providing oil to these cylinders includes an adjustable pressure regulating valve.

For very large wiper assemblies, or when space is extremely limited, it is advantageous to use compressed fluid (air or oil) spaces between upper wiper rollers 32 (and 33) and upper frame 37, and between lower wiper roller 31 and lower frame 36. Said baffles are made from a flexible elastomeric material such as nylon. Baffle 105 mounted to upper frame 37 by screws 107 is used to prevent coolant splashing over the top of the upper frame, and baffle 106 mounted to lower frame 36 by screws 108 prevents coolant splashing under the bottom of the lower frame. Two felt curtains 95, one for each side of the strip, are each slideably mounted in upper frame 37 by means of dovetail 93, and slide key 94, to which it is attached by screws 97, and back-up plate 96. These curtains can be slid into position to contact each edge of the strip, according to the exact width of strip passing through the wiper, and provide the function of prevention of coolant splashing past the edges of the strip, or being carried along the edge of strip 78 leaving the wipers.

It should be noted that the portions of strip 110 between upper and lower wiper rollers are important to the achievement of effective wiping action, since these portions are able to flex to allow intimate contact between wiper rollers and both surfaces of the strip, regardless of irregularities in the strip profile or the profile of the wiper rollers. The upper and lower wiper rollers must not be urged together with too much force (by cylinders 70) or these portions of strip will disappear, and good wiping action will no longer be achieved.

The embodiment shown in the drawings and heretofore described is by way of example only, and other embodiments are possible without departing from the spirit of the invention.

I claim:

1. A three-roller device for wiping liquids from the surface of metal strip under tension, consisting of three rollers mounted with their axes parallel to the plane of the strip and to each other, and perpendicular to the direction of strip travel, the first two of said rollers being urged against one surface of the strip, the third roller being urged against the other surface of the strip, and each roller is urged by a plurality of pairs of caster bearings, said caster bearings being mounted in carriers which are spring mounted to a rigid frame, said frame being urged towards the strip by means of cylinders powered by fluid under pressure.

2. A device as in claim 1, where said carriers for caster bearings for both of said first two rollers are mounted to a single rigid frame, said frame being urged towards the strip by means of cylinders powered by fluid under pressure.

3. A wiping device as in claim 2, wherein the plane of the strip is horizontal, and where the entire assembly consisting of said frames, rollers, casters, carriers, springs and cylinders is supported on springs with the adjacent surfaces of said three rollers substantially at the level of the strip, and where said cylinders are mounted between said frames, and can be extended to separate said first two rollers from said third roller in order to provide a gap for threading the strip, and can be retracted to urge said first two rollers against one surface of the strip, and said third roller against the other surface of the strip in order to wipe the strip surfaces.

* * * * *